United States Patent [19]

Tedder

[11] 4,139,849

[45] Feb. 13, 1979

[54] DOPPLER FUZING SYSTEM HAVING A HIGH RESISTANCE TO NOISE AND JAMMING

[75] Inventor: Paul M. Tedder, Gainesville, Fla.

[73] Assignee: The United States of America as represented by the Secretary of the Army, Washington, D.C.

[21] Appl. No.: 454,236

[22] Filed: Sep. 3, 1954

[51] Int. Cl.[2] ..... F42C 13/04

[52] U.S. Cl. ..... 343/7 PF; 102/214

[58] Field of Search ..... 343/5, 7, 7 PF; 102/70.2 P, 70.2, 214; 250/27 PD, 20.5 P, 20.282, 6.45

[56] References Cited

U.S. PATENT DOCUMENTS

| | | | |
|---|---|---|---|
| 1,483,172 | 2/1924 | Gannett | 328/162 |
| 2,263,986 | 11/1941 | Finch | 358/283 |
| 2,329,048 | 9/1943 | Hullegard | 315/183 |
| 2,430,357 | 11/1947 | Mercer | 343/17.5 |
| 2,441,030 | 5/1948 | Page | 328/5 |
| 2,489,297 | 11/1949 | Labin et al. | 328/108 |
| 2,533,871 | 12/1950 | Blitz | 343/14 |
| 2,776,370 | 1/1957 | Beveridge et al. | 328/111 |

*Primary Examiner*—T. H. Tubbesing
*Assistant Examiner*—Richard E. Berger
*Attorney, Agent, or Firm*—Nathan Edelberg; Robert P. Gibson; Saul Elbaum

[57] EXEMPLARY CLAIM

1. An electronic ordnance fuze responsive only to a signal of increasing amplitude applied for at least a predetermined minimum time, said fuze comprising: means for radiating radiofrequency energy, receiving a portion of said radiofrequency energy after reflection from a target, and mixing the radiated and reflected energy to obtain a Doppler-frequency alternating current signal of increasing amplitude as the fuze approaches the target; means for amplifying said alternating current signal; rectifier and filter means for obtaining from the amplified alternating current signal a first unipotential signal proportional to its envelope; differentiator means connected to said rectifier and filter means for obtaining a second unipotential signal which is proportional to the rate of change of said first unipotential signal; limiter means connected to said differentiator means for limiting the amplitude of the output of said second unipotential signal; and an integrator and trigger circuit to which said second unipotential signal is fed, said circuit producing a pulse which initiates detonation when said second unipotential signal has at least a predetermined minimum amplitude for at least a predetermined minimum time.

3 Claims, 2 Drawing Figures

INVENTOR
Paul M. Tedder

BY W. E. Thibodeau, A. W. Dew and J. D. Edgerton ATTORNEYS

DOPPLER FUZING SYSTEM HAVING A HIGH RESISTANCE TO NOISE AND JAMMING

This invention relates to ordnance fuzes of the radio proximity type. More particularly, it is a principal feature of the invention to provide a noise-and-jamming-resistant radio proximity fuze that will function only when it receives a signal that continues to increase in amplitude over a certain period of time.

Although it will become apparent that the invention is applicable to other fuzes and devices, description may be facilitated by considering the invention in relation to a bomb fuze of the well-known Doppler type.

In the Doppler type of radio proximity fuze a radio-frequency signal is radiated from a suitable transmitter in the projectile. As the fuze approaches a target, the target reflects part of the radiated energy back to the fuze. The relative motion of target and projectile causes the reflected signal, as received by the fuze, to be of a slightly different frequency from the transmitted signal. Intermodulation between the transmitted and received signals produces a Doppler or target signal equal to the difference frequency between the transmitted and received signal. In the ordinary Doppler fuze, this Doppler signal is amplified and applied to a thyratron. When the projectile is close enough to the target to produce a Doppler signal of predetermined amplitude, the thyratron fires and in turn fires a detonator.

Unfortunately, the simple Doppler fuze as described above is susceptible to premature detonation from noise or from jamming signals. Even a short-duration noise pulse or jamming signal may be effective.

Integrator circuits in the amplifier system have been proposed. Such circuits require the presence of a signal of suitable frequency and amplitude for a longer period of time before the thyratron will function. Although such circuits make jamming somewhat more difficult, they cause the position at which the fuze functions to vary with the velocity of the projectile.

The present invention provides a fuze that will be functioned only by a signal of approximately the correct frequency that has a certain minimum amplitude and that increases in amplitude at at least a predetermined rate for at least a predetermined time. This means that the fuze cannot be functioned by any jamming or noise signal of short duration. A step-modulated signal will likewise not prefunction the circuit, the envelope rise being of too short duration. Furthermore, because the fuze will function only in response to a predetermined type of signal, jamming is made correspondingly more difficult. Also, position can be made substantially independent of velocity over a range of at least two to one.

The most useful embodiments of the invention provide for four basic steps. First the Doppler signal, after appropriate amplification, is rectified to obtain its envelope. Second, the envelope is differentiated to obtain a unipotential differentiator output signal of amplitude proportional to the rise rate of the envelope. Third, a limiting action is provided, in order to make the extremely rapid rise rates of suddenly-applied jamming signals no more effective than the expected rise rate of the Doppler signal. Fourth, the differentiator output is integrated, so that the fuze will function only if the differentiator output remains above a certain value for a predetermined time. Close compensation for the effect of projectile velocity can be obtained by appropriate selection of circuit constants: a fast-moving projectile will produce a faster rise rate of the Doppler envelope and will thus cause the differentiator output to reach a given value at a greater distance from the target than in the case of a slower-moving projectile, but the fast-moving projectile will travel farther than the slower-moving one during the time-delay period, so that both will be at about the same distance from the target at the end of the time-delay period.

An object of the invention is to provide a compact, practical, low-cost radio proximity-type ordnance fuze that is highly resistant to noise and jamming.

Other objects, aspects, uses, and advantages of the invention will become apparent from the following description and from the accompanying drawings.

Figure 1:
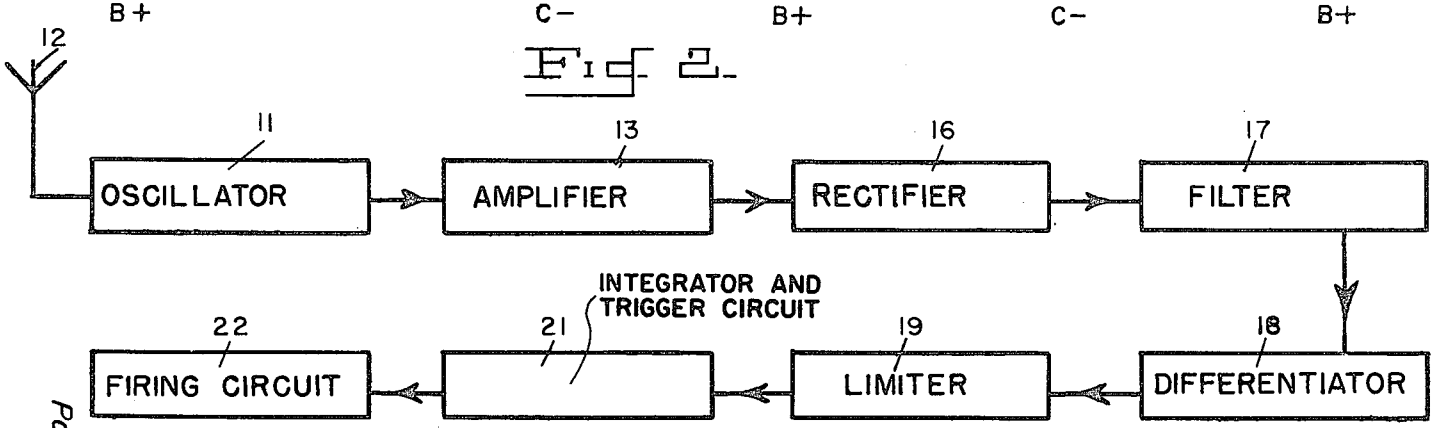
FIG. 1 is a block diagram of a Doppler-type bomb fuze in accordance with the invention.

In FIG. 1 a radiofrequency oscillator 11 is connected to an antenna 12. As the fuze approaches a target, part of the signal radiated from antenna 12 is reflected from the target and is received by antenna 12. Intermodulation between the transmitted and reflected signals gives rise to the well-known Doppler signal, which is amplified by amplifier 13. Rectifier 16 rectifies the Doppler signal to obtain a unipotential envelope voltage. This envelope voltage is practically zero when the fuze is a great distance from the target. As the fuze approaches the target the envelope voltage increases slowly at first, but the slope of the voltage-time curve becomes increasingly steep as the fuze comes closer to the target. The output of rectifier 16 is filtered by filter 17.

The filtered unipotential signal from filter 17 is applied to differentiator 18. Differentiator 18 gives a unipotential output voltage that is a measure of the rate of increase of the signal from filter 17; if the input signal does not continually increase, the output of differentiator 18 will fall to zero.

The output of differentiator 18 is applied, through limiter 19, to integrator and trigger circuit 21. Only if differentiator 18 continues to give an adequate output voltage for a sufficient predetermined length of time will integrator and trigger circuit 21 energize firing circuit 22 to cause detonation of the projectile.

From what has been said above it will be seen that firing circuit 22 will function only if a signal of suitable frequency is received that has at least a certain minimum amplitude and that continues to increase for at least a predetermined length of time.

Limiter 19 is interposed between differentiator 18 and integrator and trigger circuit 21 in order to minimize the effect of a strong jamming signal that might be suddenly applied. The output of limiter 19 reaches approximately maximum value when a normal signal is received; larger signals do not substantially increase the output of limiter 19.

It will be clear from what has been said above that a signal that rises very rapidly to its final value will not function firing circuit 22. It may be pointed out also that a signal that is either too weak or that rises to slowly will likewise not function firing circuit 22.

Figure 2:
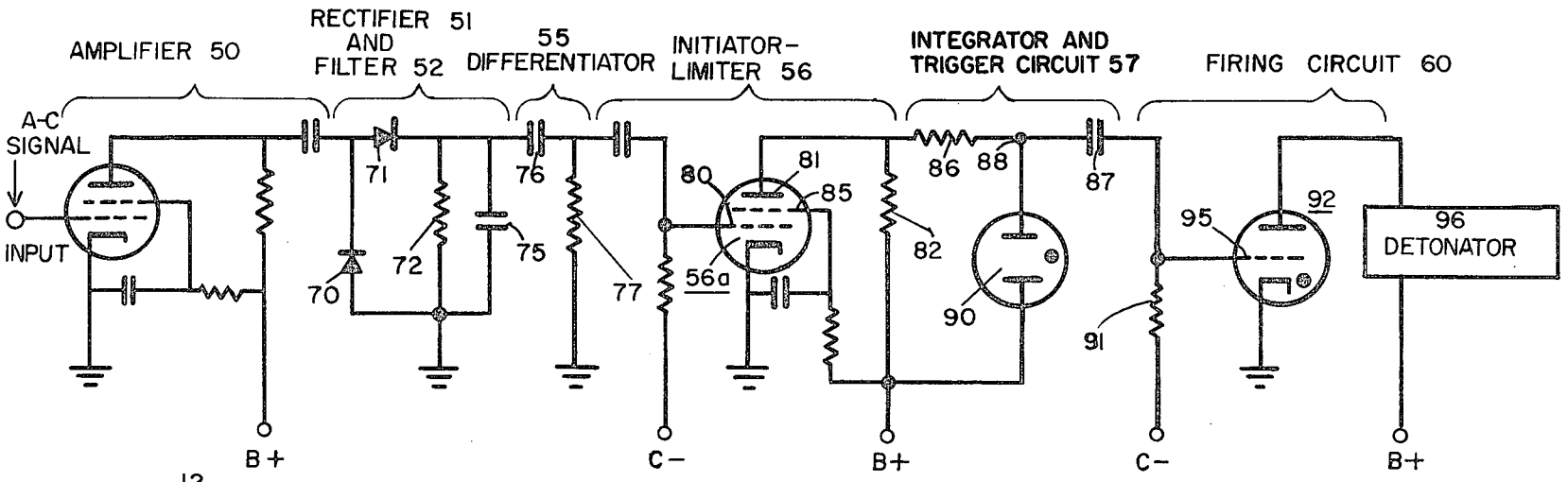
FIG. 2 is a schematic diagram of an embodiment of the invention adapted to apply energy to a detonator 96 or other load after an alternating-current signal of suitably increasing amplitude has been applied to the input for a sufficient length of time.

In FIG. 2, the embodiment of the invention shown will for the most part be readily understood on inspection in the light of what has been said above in connection with FIG. 1. The alternating-current input signal is amplified by amplifier 50 and rectified by voltage-doubler rectifier 51 which comprises diodes 70 and 71. The main purpose of resistor 72 is to mask the differences in back leakage of various selenium rectifiers. The output of rectifier 51 is filtered by filter 52, which consists of capacitor 75, and applied to differentiator 55 which consists of capacitor 76 and resistor 77. The output of differentiator 55 is applied as a positive-going signal to grid 80 of initiator-limiter 56. Grid 80 is preferably biased near the plate-current cut-off point. If a differentiator output signal is developed, the plate current of initiator-limiter 56 increases; the voltage at plate 81 drops and the output voltage across plate load resistor 82 increases.

The negative-going voltage developed across resistor 82 is applied to integrator and trigger circuit 57 which comprises resistor 86, capacitor 84 and glow discharge tube 90. Glow discharge tube 90 is preferably of the well-known neon or similar type. Resistor 86 is preferably much larger than resistor 91; a ratio of 1000 to 1 has been found satisfactory.

In the absence of a signal, the circuit input voltage — i.e., the voltage across resistor 82 — is low. Under equilibrium no-signal conditions this same low voltage appears across glow tube 90. This voltage is far below the striking voltage of glow tube 90, which presents a very high resistance. If a sufficient voltage is developed across resistor 82 for a sufficient period of time, however, capacitor 87 will discharge through resistor 86 to the point where the voltage across glow tube 90 equals the striking voltage of glow tube 90. Tube 90 will then strike. When it strikes its resistance suddenly becomes very low, and as a result a large steep positive-going pulse is suddenly applied to capacitor 87. The amplitude of this pulse is approximately equal to the difference between the striking and extinction voltages of glow tube 90.

This firing pulse is applied to firing circuit 60, which comprises thyratron 92. Before the firing pulse is received, thyratron 92 is in the nonconducting condition because of a suitable negative bias applied to grid 95. When the firing pulse is received, thyratron 92 switches to the conducting state and energizes detonator 96 or other desired load.

With the integrator circuit and trigger circuit 57 described, it will be noted that if the negative-going signal received by the circuit 57 suffices to fire glow tube 90 at all, a large positive-going firing pulse is produced that is of uniform amplitude. However, it will be understood that other electrical or mechanical integrating devices and triggering circuits can be used.

By operating initiator-limiter 56 with a rather low voltage on screen 85 — about 10 volts, for example — the tube 56a can be caused to saturate when a normal firing signal is received. This means that a much larger jamming signal will not develop an appreciably larger voltage across resistor 82. In other words, the desired limiting action is obtained.

It will be understood that if the fuze is incorporated in a fast-falling bomb, the output signals from differentiator 55 and initiator-limiter 56 will build up more rapidly than in the case of a slower-falling bomb. In other words, the voltage at the input to integrator and trigger circuit 57 will reach a given value at a greater height above the ground in the case of the fast-falling bomb. However, the relation between the characteristics of initiator-limiter 56 and the delay introduced by integrator and trigger circuit 57 can be so adjusted as to give close compensation for the effect of bomb speed, so that bombs varying widely in speed will explode at practically the same height above the ground. It can be shown by analysis, and it has been demonstrated, that exact compensation can be effected for any two speeds of interest, the resulting compensation then being somewhat less exact at other speeds. For example, fuzes have been compensated to function at 100 feet for bomb speeds of 500 and 1000 feet per second and have been found to vary in function height by not more than 3 percent at intermediate speeds, factors other than speed being kept constant.

Selection of optimum values of resistor 86 and capacitor 87 involves a compromise between several factors. Experimentally, the optimum time constant for normal operation appears to be of the order of 0.05 to 0.10 seconds. Values of 0.005 to 0.01 microfarad for capacitor 87 and of 5 to 10 megohms for resistor 86 have proven practical.

It has been found that adjustment of function height and compensation for bomb speed can conveniently be obtained by adjusting either (a) the time constant of resistor 86 and capacitor 87 or (b) the voltage applied to screen 85, or both.

It may be desirable to restrict the frequency response of amplifier 50 to those frequencies that desired firing signals are expected to have. In this way susceptibility to jamming and to the effects of noise and ripple can be still further reduced. For example, suitable shaping of the response of amplifier 50 can be readily accomplished with well-known feedback circuits.

It will be seen that high ripple and noise levels will not detonate the fuze. Also, it is noteworthy that the several important performance advantages of the invention can be obtained in a compact, low-cost unit having only a few more components than an ordinary easily-jammed fuze. The reflection coefficient of the area in which the bomb is dropped affects the function height of the fuze of the invention. However, this effect of reflection coefficient is no greater, and under some circumstances appreciably less, than with amplitude-operated fuzes. But if the value of the reflection coefficient is lower than about one-fourth of the expected value for which the fuze has been designed, the unit is likely to dud. The entire range of probable values of reflection coefficient can be taken care of by means of a simple 2:1 voltage divider between the oscillator and the amplifier. This divider can be designed so as to be easily eliminated by field personnel, when conditions of extremely low reflection coefficients are encountered, by removing a grounding screw from the housing of the fuze.

Although the foregoing description and discussion has centered around embodiments of the invention is a bomb fuze of the Doppler type, it will be understood that the invention is not limited in applicability to bomb fuzes or to Doppler-type fuzes.

It will be apparent that the embodiments shown are only exemplary and that various modifications can be made in construction and arrangement within the scope of the invention as defined in the appended claims.

I claim:

1. An electronic ordnance fuze responsive only to a signal of increasing amplitude applied for at least a predetermined minimum time, said fuze comprising: means for radiating radiofrequency energy, receiving a portion of said radiofrequency energy after reflection from a target, and mixing the radiated and reflected energy to obtain a Doppler-frequency alternating current signal of increasing amplitude as the fuze approaches the target; means for amplifying said alternating current signal; rectifier and filter means for obtaining from the amplified alternating current signal a first unipotential signal proportional to its envelope; differentiator means connected to said rectifier and filter means for obtaining a second unipotential signal which is proportional to the rate of change of said first unipotential signal; limiter means connected to said differentiator means for limiting the amplitude of the output of said second unipotential signal; and an integrator and trigger circuit to which said second unipotential signal is fed, said circuit producing a pulse which initiates detonation when said second unipotential signal has at least a predetermined minimum amplitude for at least a predetermined minimum time.

2. The invention in accordance with claim 1 wherein said fuze is incorporated in a bomb, and the characteristics of said limiter and the delay introduced by said integrator and trigger circuit are adjusted so as to maintain a constant bomb detonation height with variations in bomb velocity.

3. The invention in accordance with claim 2 wherein said rectifier and filter means comprises a voltage-doubler diode circuit; said differentiator means comprises a capacitance in series with a resistance; said limiter means comprises an electron tube that becomes substantially saturated when said second unipotential signal reaches the maximum value expected from a normal target signal; and said integrator and trigger circuit comprises a resistor in series with a capacitor forming a timing circuit, and a glow-discharge tube connected so as to conduct and produce said pulse when said capacitor charges to a predetermined potential.

* * * * *